US009044776B2

(12) United States Patent
Riga, Jr. et al.

(10) Patent No.: US 9,044,776 B2
(45) Date of Patent: Jun. 2, 2015

(54) STABILIZED HIGH FLOW DOCTOR BLADE HEAD FOR TRANSFER ROLLER

(75) Inventors: Thomas James Riga, Jr., Loomis, CA (US); Aaron Stephen Fieguth, Roseville, CA (US); Danny Richard Gubbels, Forest Ranch, CA (US)

(73) Assignee: Harris & Bruno Machine Co., Inc., Roseville, CA (US)

( * ) Notice: Subject to any disclaimer, the term of this patent is extended or adjusted under 35 U.S.C. 154(b) by 160 days.

(21) Appl. No.: 13/603,172

(22) Filed: Sep. 4, 2012

(65) Prior Publication Data

US 2014/0060426 A1 Mar. 6, 2014

(51) Int. Cl.

| | |
|---|---|
| ***B05C 11/04*** | (2006.01) |
| ***B05C 1/08*** | (2006.01) |
| ***D21H 23/22*** | (2006.01) |
| *B41F 31/02* | (2006.01) |

(52) U.S. Cl.

CPC ..... *B05C 11/04* (2013.01); *B05C 1/0817* (2013.01); *B41F 31/027* (2013.01); *B05C 1/0813* (2013.01); *B05C 1/0834* (2013.01); *B05C 11/042* (2013.01); *B05C 11/045* (2013.01); *B05C 11/047* (2013.01); *B05C 11/048* (2013.01); *D21H 23/22* (2013.01)

(58) Field of Classification Search

CPC ..... B05C 11/04; B05C 11/047; B05C 11/10–11/115; B05C 1/0813; B05C 1/0817; B05C 1/0834; D21H 23/22; B41F 31/027

USPC ..... 118/410, 413, 419, 261; 101/350.6

See application file for complete search history.

(56) References Cited

U.S. PATENT DOCUMENTS

| | | | | |
|---|---|---|---|---|
| 3,695,221 | A | 10/1972 | Schaeuble | |
| 4,091,129 | A | 5/1978 | Schaeuble | |
| 4,590,857 | A | 5/1986 | Dahlgren | |
| 4,615,295 | A | 10/1986 | Wittkopf | |
| 5,121,689 | A * | 6/1992 | Fadner | 101/365 |
| 5,325,775 | A | 7/1994 | Grosshauser et al. | |
| 6,012,391 | A | 1/2000 | Weishew | |
| 6,276,270 | B1 * | 8/2001 | Leanna | 101/350.6 |
| 6,576,059 | B2 * | 6/2003 | Burgard | 118/683 |
| 2001/0050014 | A1 * | 12/2001 | Bock et al. | 101/350.6 |

* cited by examiner

*Primary Examiner* — Laura Edwards

(74) *Attorney, Agent, or Firm* — Howard Cohen

(57) ABSTRACT

A doctor blade head for coating a transfer roller includes a semi-cylindrical cavity to enable streamline fluid flow therethrough, and check plates at the inlet and outlet openings for permitting unidirectional flow into the inlet opening from said pump and out of the outlet opening toward the pump. An hydraulic accumulator acts as a fluid pressure and fluid velocity balancing device, and includes a rolling diaphragm piston moving in a cylinder that is connected to the inlet fluid path, with a spring impinging on the piston to absorb pressure surges and compensate pressure dropoffs.

13 Claims, 4 Drawing Sheets

STABILIZED HIGH FLOW DOCTOR BLADE HEAD FOR TRANSFER ROLLER

CROSS-REFERENCE TO RELATED APPLICATIONS

Not Applicable.

FEDERALLY SPONSORED RESEARCH

Not applicable.

SEQUENCE LISTING, ETC ON CD

Not applicable.

BACKGROUND OF THE INVENTION

1. Field of the Invention

This invention relates to doctor blade systems for applying coatings in a printing or coating process, and in particular to a new design for the doctor blade head.

2. Description of Related Art

In the application of liquid substances to a moving web or successive sheets of material, it is considered well known in the art to apply the liquid using a rotating transfer roller, and to directly apply the liquid uniformly onto the roller by means of a doctor blade assembly. The doctor blade assembly generally includes a reservoir chamber extending the length of the transfer roller and in contact with the circumferential surface thereof, and a pair of doctor blades extending longitudinally on either side of the chamber. The doctor blades are angled obliquely toward the transfer roller surface, and serve both to seal the reservoir chamber to the roller and to form a uniform film of liquid on the roller transfer surface. The assembly also must include some means to seal the reservoir chamber at the ends of the roller, so that the liquid is not flung from the roller into the surroundings, and so that the liquid may be pumped through the reservoir during the transfer process. Such transfer systems are used in flexographic and gravure printing, adhesive applicators for substrates such as paper or plastic, coating applicators in many different industrial processes, and the like. Exemplary system are described in U.S. Pat. Nos. 4,821,672 and 6,576,059 issued to Nick Bruno.

It is apparent that the doctor blade head must provide uniform coating of the transfer roller to the utmost extent, so that the printed output is as perfect as possible. Factors that may cause defects in the liquid layer on the transfer roller may include the transfer roller itself, which is furnished with a micro-etched pattern designed to sustain the liquid film that is transferred to the printing or coating roller. The pattern may also carry air into the doctor blade cavity and cause bubbles to form in the coating liquid in the cavity, leading to defects in the coating and printing drop-outs in the final product. This effect is also exacerbated by the rotational velocity of the transfer roller and printing roller, and may limit the production speed of the printing press.

Indeed, the doctor blade cavity may be viewed as a closed space having fixed side and end wall, except for the rapidly and constantly moving side wall formed by the transfer roller engaged by the doctor blade head. In the prior art the cavity is typically a flattened rectangular chamber, and the fluid flow is end-to-end through the cavity. It is quite possible for turbulence to occur within the flowing liquid, which retards the flow rate and requires higher pumping pressure to maintain the fluid flow through the chamber. Turbulence may be increased by the motion of the transfer roller surface forming one side of the cavity, again limiting the speed of the printing press.

In addition to the issue of turbulence, the pump that provides the pressurized fluid to the cavity typically creates pulses of pressure, particularly since pneumatically operated piston pumps are easiest to use and maintain in a transfer coating machine. Instability in the fluid pressure may also contribute to turbulence in the fluid and an ultimate degradation in printing quality.

BRIEF SUMMARY OF THE INVENTION

The present invention generally comprises an improved doctor blade head for coating a transfer roller. The doctor blade head is provided with several salient features that enable a high velocity flow of coating liquid longitudinally through the doctor blade chamber, while requiring a lower overall fluid pressure across the chamber. Higher fluid flow rates through the chamber enables the chamber to be replenished with fresh fluid more often, and less air (foam) is introduced into the fluid from the anilox roller surface that moves across the doctor blade opening.

In one aspect, the chamber is configured as a quasi-cylindrical cavity that is more similar to a round pipe than prior art designs, thereby allowing fluid flow with less restrictions (resistance) than previous chamber cavity designs. The decreased resistance increases the fluid velocity and decreases the pump pressure required to move fluid through the cavity.

In a further aspect, the doctor blade head is provided with a check plate mounted in the inlet side of the chamber that allows fluid into the cavity from the cavity inlet that is connected to a pump, but does not let fluid back-flow out of the cavity through the inlet side. There is another check plate mounted in the outlet side of the chamber that allows fluid to flow out of the cavity but prevents fluid flow into the chamber from the outlet side. These check plates enable the system to maintain a very low and unchanging fluid pressure in the cavity of the chamber. They also keep the chamber cavity completely filled at all times of operation, not allowing air into the cavity from outside the chamber system, which can cause large starvation spots (dropouts) on the anilox roller.

The invention also provides an hydraulic accumulator for stabilizing the pump pressure that feeds the chamber. The hydraulic accumulator acts as a fluid pressure and fluid velocity balancing device, and includes a rolling diaphragm piston moving in a cylinder that is connected to the inlet fluid path, with a spring impinging on the piston. If there is a fluid pressure spike from the chamber supply pump, it enters the cylinder though the inlet manifold, and pushes the rolling diaphragm to move outwardly in the cylinder against the spring, thus storing the energy and fluid from that pressure spike. As the fluid pressure decreases from the pump and in the chamber cavity, in between strokes, the spring pushes the stored fluid into the chamber cavity so that the hydraulic accumulator releases that energy and fluid into the chamber. The result of this that pressure spikes are attenuated and pressure dropoffs are compensated, so that there is continuous fluid flow through the chamber at a very stable fluid pressure. As the supply pump delivers more or less fluid, the hydraulic accumulator keeps the fluid pressure stable, and the chamber cavity completely filled when used in conjunction with the check-plates.

DETAILED DESCRIPTION OF THE INVENTION

Figure 1:
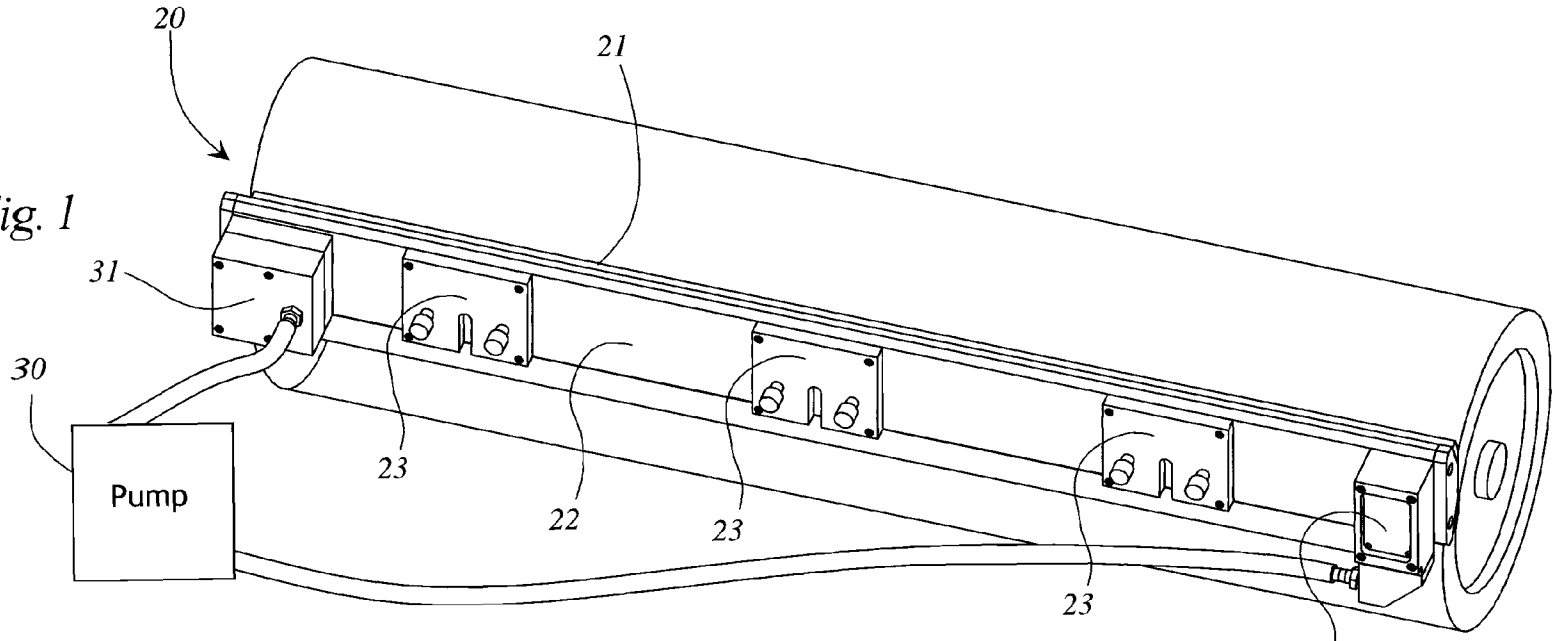
FIG. 1 is a perspective rear view of the doctor blade head of the invention, shown engaged with a transfer roller.
Figure 2:
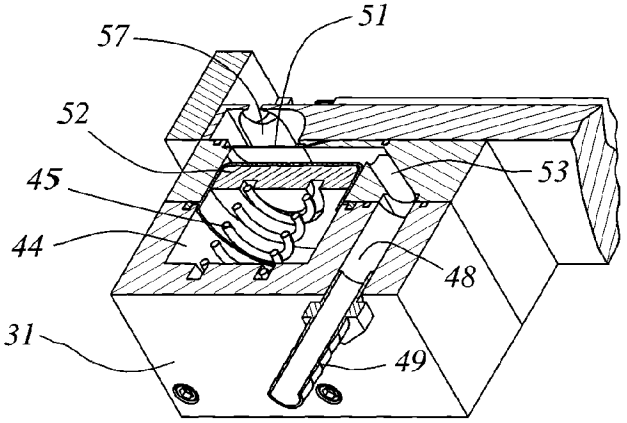
FIG. 2 is a partially cross-sectioned perspective view of the hydraulic accumulator of the invention.
Figure 3:
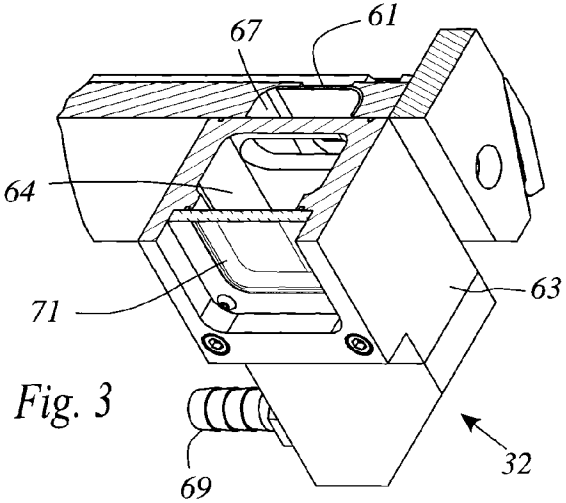
FIG. 3 is a partially cross-sectioned perspective view of the doctor blade chamber outlet assembly of the invention.
Figure 10B:
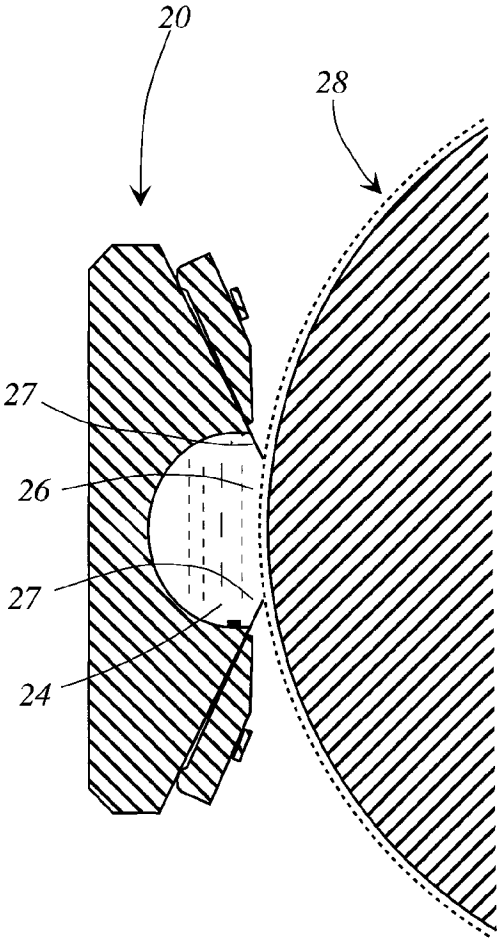
FIG. 10B is a cross-sectional side elevation of the doctor blade head of the invention.

The present invention generally comprises an improved doctor blade head for coating a transfer roller that delivers a high velocity flow of coating liquid longitudinally through the doctor blade chamber, while providing a lower, more stable fluid pressure across the chamber. As shown in FIG. 1, the doctor blade head 20 generally includes a channel-like structure 21 having a central web portion 22 with a plurality of mounting brackets 23 for securing the doctor blade head to a supporting framework (not shown). The head 20 includes a longitudinally extending cavity 24 (FIG. 10B) that has a longitudinally extending opening 26. A pair of doctor blades 27 are secured in opposed, parallel fashion adjacent to the opening 26, and are disposed to impinge on a rotating transfer roller 28, whereby a film of coating fluid is applied to the roller. The roller may comprise an anilox roller or the equivalent known in the prior art.

As shown in FIG. 1, a fluid pump 30 has its output connected through tubing or hose to an inlet assembly 31 disposed at one end of the structure 21, and the inlet of the pump is connected to an outlet manifold assembly 32 disposed at the other end of the structure 21, so that fluid from the pump flows the length of the cavity 24 before returning to the pump.

A salient feature of the invention is an hydraulic accumulator 41 for stabilizing the pressure applied to the fluid in the doctor blade cavity 24. The hydraulic accumulator 41 is located in the inlet assembly 31, and is shown in FIGS. 2, 4-6, and 10. With regard to FIGS. 2 and 10, the hydraulic accumulator is comprised of an outer housing plate 42 and an inner housing plate 43 in stacked relationship and secured by bolts to the outer surface of the web 22 of channel-like structure 21. The housing plates are provided with cylindrical recesses 44 and 47 that are equal in diameter and axially aligned to form a closed cylindrical space. A rolling diaphragm piston 52 is entrained between the opposed faces of the plates 42 and 43, defining a variable volume fluid chamber 56 at the inner side and an outer chamber 44 that is open to ambient pressure. A spring 45 is seated in an annular groove 46 in the recess 44 to exert a resilient force to bias the piston 52 to extend into the recess 47 of plate 43. A fluid passage 48 extends through the plate 42 and is connected at its outer end to a standard male connector 49 for a supply tubing extending to the pump outlet. Within the plate 43 a fluid passage 53 is aligned with and joins the passage 48, the fluid passage extending to fluid chamber 56.

The inner end of housing plate 43 is provided with a port 54 that communicates with the fluid chamber 56. The port 54 also provides an annular seat 55 for an inlet check plate 51, a flexible tongue that is shaped to occlude the port 54. An inlet opening 57 is formed in the web 22 of doctor blade channel 21 in communication with the cavity 24, the opening 57 providing a large area through which the fluid may pass so that locally generated turbulence is avoided. The opening 57 also provides space for the check plate 51 to deflect inwardly in a resilient fashion (FIGS. 5 and 6) to allow fluid to enter the cavity 24 from the fluid chamber 56. However, any retrograde flow from the cavity 24 toward the chamber 56 is blocked by the plate 51 urged to impinge on the seat 55 by the retro-flow as well as its own resilient restoring force. Thus if the input fluid pressure should falter for whatever reason, the check plate 51 prevents backflow out of the cavity 24, an event that could, for example, potentially draw air into the system and cause starvation spots on the transfer roller.

Note that bolts are used to join the housing plates to the channel web 22, along with appropriate seals to contain the fluid, but they are not enumerated herein.

Figure 4:
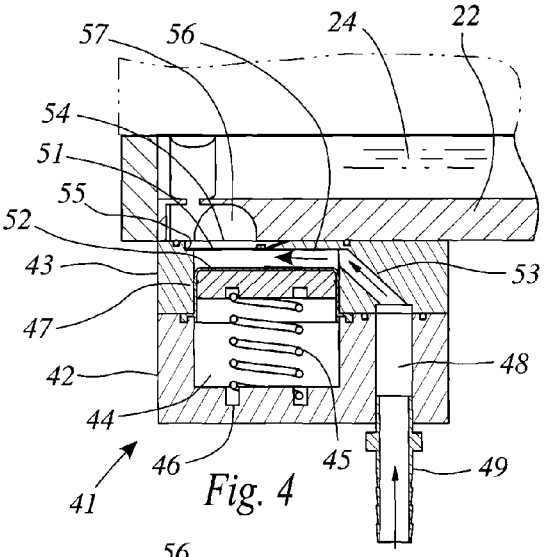
FIGS. 4-6 are cross-sectional elevations of the hydraulic accumulator shown in FIG. 2, depicting sequentially the operation of the accumulator.
Figure 5:
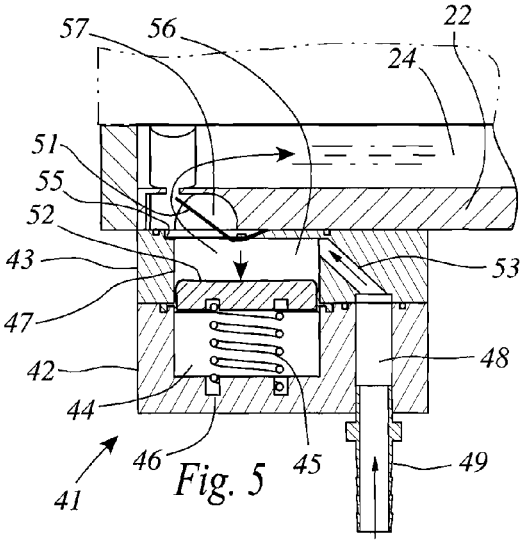
Figure 6:
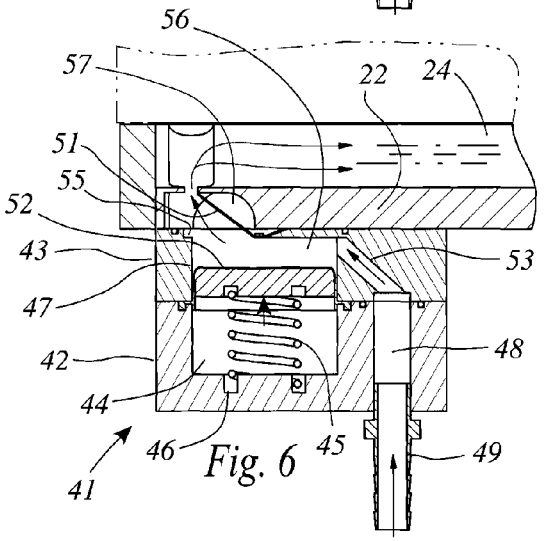
Figure 7:
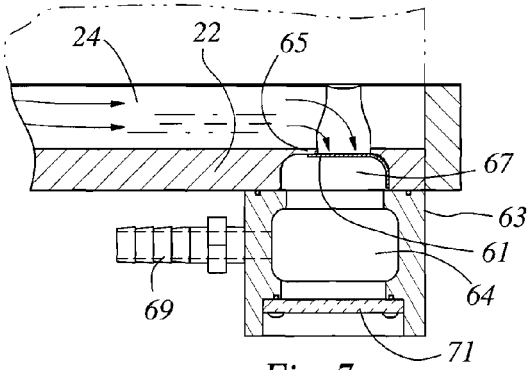
FIGS. 7-9 are cross-sectional elevations of the outlet check plate assembly shown in FIG. 3, depicting sequentially the operation of the outlet check plate.

The hydraulic accumulator 41 functions as shown in the sequence depicted in FIGS. 4-6. When fluid from the pump enters the accumulator 41 from fitting 49 and passages 48 and 53, the fluid flows into fluid chamber 56, as shown in FIG. 4. If there is a pressure spike in the fluid, it will overcome the force of spring 45 and cause the piston 52 to deflect (FIG. 5) and enlarge the fluid chamber 56, thus absorbing the pressure surge before it is transmitted to the cavity 24. Note that the hydraulic accumulator does not interrupt the fluid flow to the cavity 24, which continues as the check plate 51 is opened by the fluid flow advancing through port 54 and opening 57 into the cavity 24. As the pressure spike passes, the piston 52 is urged by spring 45 to return inwardly, driving excess fluid from chamber 56 into the cavity 24. The net result is that pressure spikes are attenuated, pressure dropoffs between pump strokes are compensated, and fluid pressure applied to the doctor blade cavity is stabilize to a high degree.

Figure 8:
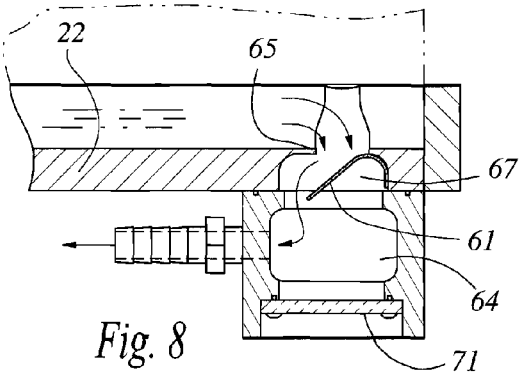
Figure 9:
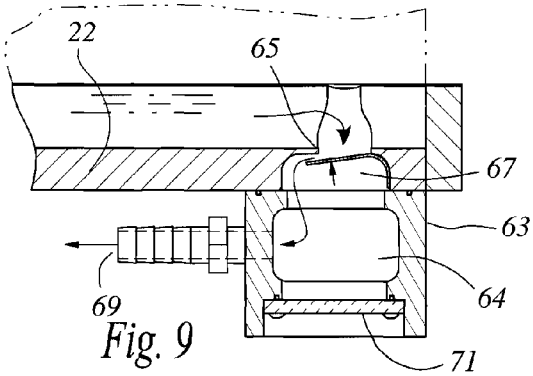

A further aspect of the invention, shown in FIGS. 3, 7-9, and 12, is the provision of an outlet check plate in the outlet manifold assembly 32. The web 22 is provided with an outlet opening 67 at the end that is longitudinally opposed to the inlet assembly, the outlet opening having sufficient area and smooth surface transitions to enable fluid flow therethrough without creating backpressure or turbulence in the cavity 24. A rectangular housing 63 is secured to the web 22, and the housing is provided with a chamber 64 extending therethrough. At the inner end of the housing 63 the chamber 64 is aligned in flow communications with outlet opening 67. A check plate 61 is secured within the opening 67, the check plate comprising a flexible tongue that is shaped to occlude the opening 67. An annular seat 65 surrounds the opening 67 and is disposed to engage the check plate 61 in a manner similar to the seat 55 and check plate 51, except that fluid flow is blocked if retrograde into the cavity 24 but free-flowing out of opening 67. as shown in FIGS. 8 and 9. At the outer end of the housing 63 a transparent window is secured and sealed at the opening of chamber 64, providing a watch glass for visual inspection of the fluid outflow from the doctor blade chamber. A tapered end 68 protrudes from a lower side of the housing 63, and a male tubing connector 69 extends therefrom to form a flow path from the outlet 67 past the check plate 61 and through the chamber 64, thence out of the connector 69 to return to the pump 30.

Note that the two check plates 51 and 61 act together to maintain the cavity 24 completely filled with fluid at all times, and enable the system to run at a very low fluid pressure in the cavity, while the hydraulic accumulator regulates and stabilizes the fluid pressure in the cavity.

Figure 10A:
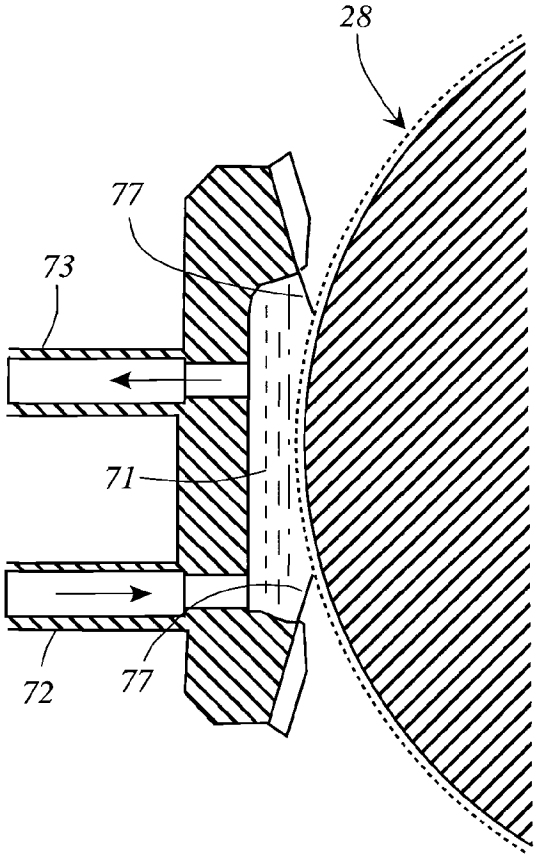
Prior Art Fig. 10A
FIG. 10A is a cross-sectional side elevation of a typical doctor blade head known in the prior art.
Figures 11, 12:
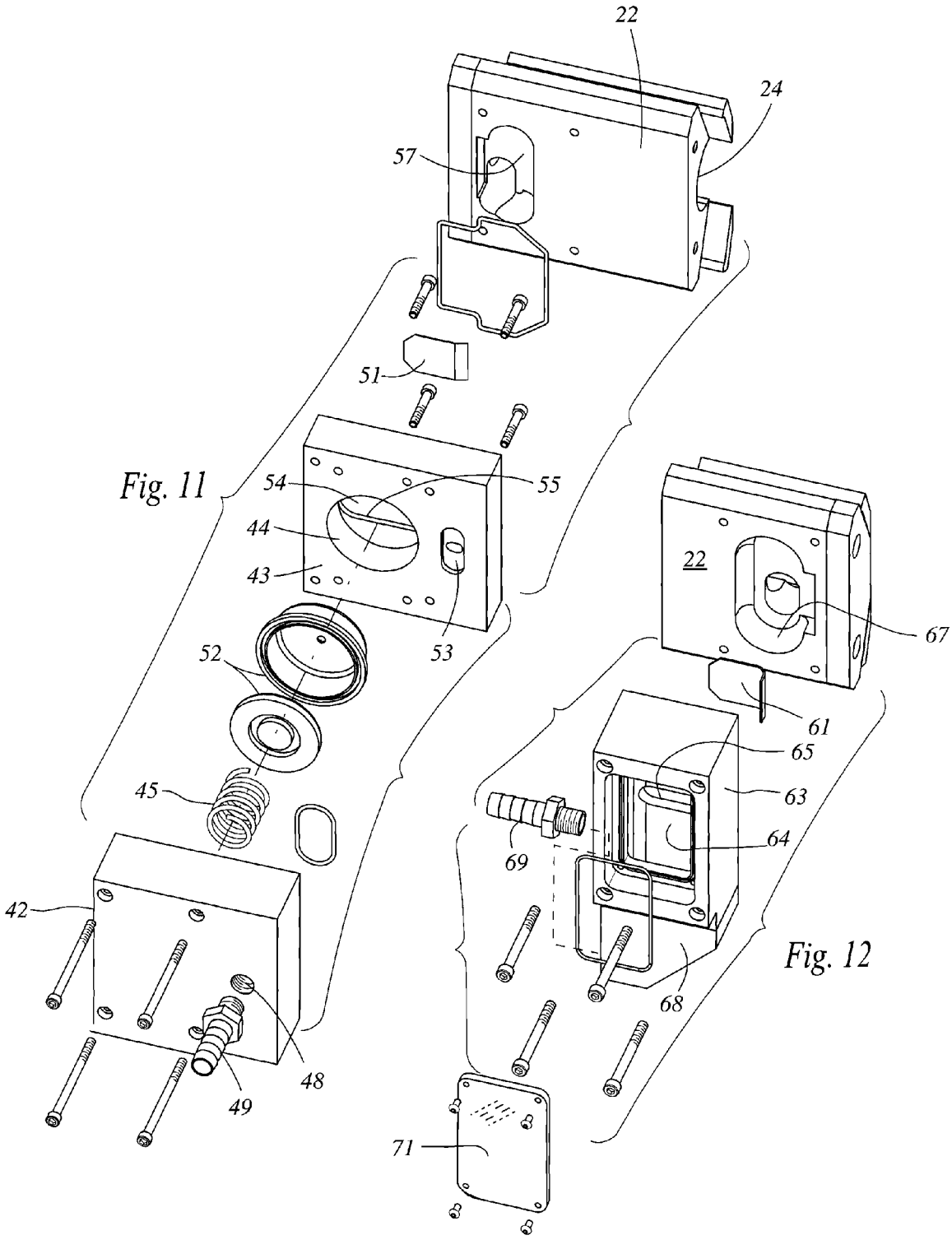
FIG. 11 is an exploded view of the hydraulic accumulator of the invention.
FIG. 12 is an exploded view of the outlet check plate assembly of the invention.

Another important aspect of the invention is the shape of the cavity 24 of the doctor blade head 20. With reference to FIG. 10A, a typical chambered doctor blade head known in the prior art is provided with a cavity 71 that is generally shaped as a flattened rectangle, with inlet and outlet connections 72 and 73 that open to the cavity in directions that are essentially transverse to the fluid flow along the longitudinal length of the cavity (parallel to the transfer roller axis). As a result turbulence may occur, requiring higher pump pressure and a wider opening between the doctor blades 77 in order to assure complete coating of the transfer roller surface.

In contrast with the prior art, the doctor blade head 20 of the invention (FIG. 10B) provides a cavity 24 that is configured as a quasi-cylindrical cavity that is more similar to a round pipe, thereby allowing a more streamline fluid flow with less restrictions (resistance) than previous chamber cavity designs. Note also that the opening 26 between the doctor blades 27 is substantially narrower than prior art devices; i.e., subtending an angle about the transfer roller axis that is as little as half the angle subtended by prior art devices (FIG. 10A). This reduction in contact area, made possible by the hydraulic accumulator 41 and check plates 51 and 61, reduces vibration between the head and the roller and facilitates the application of a uniform coating.

The foregoing description of the preferred embodiments of the invention has been presented for purposes of illustration and description. It is not intended to be exhaustive or to limit the invention to the precise form disclosed, and many modifications and variations are possible in light of the above teaching without deviating from the spirit and the scope of the invention. The embodiment described is selected to best explain the principles of the invention and its practical application to thereby enable others skilled in the art to best utilize the invention in various embodiments and with various modifications as suited to the particular purpose contemplated. It is intended that the scope of the invention be defined by the claims appended hereto.

The invention claimed is:

1. In a chambered doctor blade assembly having a longitudinally extending cavity containing a coating fluid and a pair of parallel doctor blades extending to contact the cylindrical surface of a transfer roller and seal the cavity to the transfer roller, the cavity having inlet and outlet openings and a pump for circulating coating fluid to and from said inlet and outlet openings, respectively, of the cavity, the improvement comprising:

hydraulic accumulator means connected between an output of the pump and said inlet opening extending into the cavity for attenuating fluctuations in fluid pressure from the pump.

2. The improved chambered doctor blade assembly of claim 1, wherein said hydraulic accumulator means includes a variable volume fluid chamber connected to receive said fluid pressure from the pump and expand in response to a pressure surge and contract in response to a pressure dropoff in said fluid pressure.

3. The improved chambered doctor blade assembly of claim 2, wherein said variable volume fluid chamber includes a cylinder having a piston slidably sealed therein, said variable volume fluid chamber being in fluid communication with said pump pressure.

4. The improved chambered doctor blade assembly of claim 3, further including spring means for impinging on said piston urging said piston into said cylinder to contract said variable volume fluid chamber.

5. The improved chambered doctor blade assembly of claim 4, wherein said piston includes a rolling contact diaphragm to seal said variable volume fluid chamber.

6. The improved chambered doctor blade assembly of claim 1, further including inlet check plate means interposed between the pump output and the inlet opening for permitting fluid to flow from the pump outlet into the cavity but block fluid flow from the cavity retrograde toward the pump outlet.

7. The improved chambered doctor blade assembly of claim 6, wherein said inlet check plate means includes a first seat extending about a portion of the inlet opening, and an inlet check plate secured adjacent to said first seat and disposed to impinge thereon to block retrograde fluid flow through said inlet opening.

8. The improved chambered doctor blade assembly of claim 7, wherein said inlet check plate comprises a resilient tongue-like component having a restoring force oriented toward blocking said retrograde fluid flow through said inlet opening.

9. The improved chambered doctor blade assembly of claim 8, wherein said outlet opening extends into the cavity and is disposed in longitudinally opposed fashion to said inlet opening, and means for connecting said outlet opening to an intake of the pump, and further including outlet check plate means interposed between said outlet opening and said pump intake for permitting fluid to flow from said cavity toward said pump intake but block fluid flow toward the cavity retrograde from said pump intake.

10. The improved chambered doctor blade assembly of claim 9, wherein said outlet check plate means includes a second seat extending about a portion of the outlet opening, and an outlet check plate secured adjacent to said second seat and disposed to impinge thereon to block retrograde fluid flow through said outlet opening toward said cavity.

11. The improved chambered doctor blade assembly of claim 10, wherein said outlet check plate comprises a resilient tongue-like component having a restoring force oriented toward blocking said retrograde fluid flow through said outlet opening toward said cavity.

12. In a chambered doctor blade assembly having a longitudinally extending cavity containing a coating fluid and a pair of parallel doctor blades extending to contact the cylindrical surface of a transfer roller and seal the cavity to the transfer roller, the cavity having inlet and outlet openings and a pump for circulating coating fluid to and from said inlet and outlet openings, respectively, of the cavity, the improvement comprising:

said inlet opening extending into the cavity and connected to an output of the pump, said outlet opening extending into the cavity and disposed in longitudinally opposite ends to said inlet opening, said cavity having a semi-cylindrical conformation in said longitudinal direction to enable streamline fluid flow therealong; and, hydraulic accumulator means connected between said output of the pump and said inlet opening for attenuating fluctuations in fluid pressure from the pump.

13. The improved chambered doctor blade assembly of claim 12, further including check plate means at said inlet opening and outlet opening for permitting unidirectional flow into said inlet opening from said pump and out of said outlet opening toward said pump.

* * * * *